US005715718A

United States Patent [19]

Rigsby et al.

[11] Patent Number: 5,715,718

[45] Date of Patent: Feb. 10, 1998

[54] HYDROFORMING OFFSET TUBE

[75] Inventors: Donald R. Rigsby, Jenison; Jerome C. Abbott, Birmingham, both of Mich.

[73] Assignee: Benteler Automotive Corporation, Grand Rapids, Mich.

[21] Appl. No.: 607,820

[22] Filed: Feb. 27, 1996

[51] Int. Cl.[6] ..... B21D 39/20; B21D 26/02

[52] U.S. Cl. ..... 72/57; 72/58; 72/61; 29/421.1

[58] Field of Search ..... 72/52, 58, 59, 72/60, 61, 62; 29/421.1

[56] References Cited

U.S. PATENT DOCUMENTS

| | | | |
|---|---|---|---|
| 3,169,365 | 2/1965 | Benjamen . | |
| 3,635,031 | 1/1972 | Haddad . | |
| 4,293,995 | 10/1981 | Jordan . | |
| 4,317,348 | 3/1982 | Halene et al. | 72/58 |
| 4,763,503 | 8/1988 | Hughes et al. | 72/57 |
| 5,107,693 | 4/1992 | Olszewski et al. . | |
| 5,170,557 | 12/1992 | Rigsby . | |
| 5,189,790 | 3/1993 | Streubel et al. . | |
| 5,333,775 | 8/1994 | Bruggemann et al. . | |
| 5,363,544 | 11/1994 | Wells et al. . | |
| 5,396,786 | 3/1995 | Bartholomew et al. | 72/58 |
| 5,415,021 | 5/1995 | Folmer . | |
| 5,445,001 | 8/1995 | Snavely . | |
| 5,460,773 | 10/1995 | Fritz et al. . | |
| 5,466,146 | 11/1995 | Fritz et al. . | |
| 5,471,857 | 12/1995 | Dickerson . | |
| 5,475,911 | 12/1995 | Wells et al. . | |
| 5,485,737 | 1/1996 | Dickerson | 72/57 |
| 5,499,520 | 3/1996 | Roper | 72/58 |

FOREIGN PATENT DOCUMENTS

| | | | |
|---|---|---|---|
| 494843A1 | 7/1992 | European Pat. Off. . | |
| 647771A1 | 4/1995 | European Pat. Off. . | |
| 683305A2 | 11/1995 | European Pat. Off. . | |
| 4019899C1 | 12/1991 | Germany . | |
| 45-1344 | 1/1970 | Japan . | |
| 55-10328 | 1/1980 | Japan . | |
| 55-54227A | 4/1980 | Japan . | |
| 77934 | 6/1980 | Japan | 72/57 |
| 61-86029A | 5/1986 | Japan . | |
| 255725 | 11/1986 | Japan | 72/58 |
| 61-255725A | 11/1986 | Japan . | |
| 63-220929A | 9/1988 | Japan . | |
| 385146 | 3/1965 | Switzerland . | |
| 593768 | 2/1978 | U.S.S.R. . | |
| 1355312A | 11/1987 | U.S.S.R. . | |
| 2287203 | 9/1995 | United Kingdom . | |

*Primary Examiner*—David Jones
*Attorney, Agent, or Firm*—Price, Heneveld, Cooper, DeWitt and Litton

[57] ABSTRACT

Apparatus for mechanically and hydroform reconfigurating an elongated tubular workpiece in an elongated cavity between upper and lower tool subassemblies each composed of a plurality of independent tool segments movable axially, relative to the cavity axis, together or spaced from each other, and independently movable transversely of the cavity, usually vertically, in sequence, to grip the end portions of the workpiece while its ends are flared with tapered mandrels, and after the workpiece is filled with liquid, offset deform one workpiece portion while the tool segments are spaced apart and with axial infeed of workpiece material, then offset deform another portion with further axial infeed of workpiece material. Hydroforming pressure is then applied to partially expand the workpiece. Then after withdrawing segment spacing stops, forcing the tool segments together, and totally closing the tool, a greater hydroforming pressure is applied in the workpiece to expand it to the specific cavity configuration. After pressure is relaxed and the mandrels retracted, the tool segments are temporarily held together until the finished part is ejected and removed, and then allowed to separate under force of biasing springs.

20 Claims, 14 Drawing Sheets

HYDROFORMING OFFSET TUBE

BACKGROUND OF THE INVENTION

This invention relates to the forming of a tubular workpiece into a reconfigurated complex shape and size, and particularly to tubular items such as configurated exhaust conduits for internal combustion engines and structural chassis support members such as cross members, shock towers, lateral supports, etc.

Exhaust conduits for engines of modern vehicles are sometimes required to be of complex configuration to fit within the close confines allowed for the conduit to extend from the engine exhaust manifold to the underside of the vehicle. Forming of hollow steel conduit to such complex configurations presents significant problems due to the tendency of the tube to crush and/or gather or wrinkle, and to form thin walled areas during mechanical deformation from its cylindrical shape. Crushing tends to restrict gaseous flow as well as creating weak zones in the tube. Successive areas of thinner and thicker metal along the tube not only results in weak zones, but also undesirable different rates of expansion, contraction and heat dissipation along the tube. The problem becomes particularly acute when a substantial transverse offset is to be formed in the workpiece. A special transverse offset may be necessary as for mounting an oxygen sensor thereon. Oxygen sensors may be necessary for exhaust gas pollution monitoring and control. Legal standards now require diagnostics to detect quality of exhaust emissions over a period of time. An oxygen sensor behind the catalytic converter is important for this purpose. It must be located on top of the exhaust pipe to avoid water. This requires a special offset pipe portion. Yet, offsetting can cause splitting, wrinkles, excess thinning, galling or scratching, all of which are undesirable.

SUMMARY OF THE INVENTION

An object of this invention is to provide a novel apparatus and method for reconfigurating a cylindrical tube into a unique complex configuration with substantially uniform wall thickness along its length, absence of crush zones of weakness, and having zones which are offset transversely relative to the tube axis for mounting of oxygen sensors or the like, but without splitting, wrinkles, excess thinning, galling or scratching. The invention specially combines mechanical forming and hydroforming in a manner to create an exhaust conduit that effects excellent gaseous flow and structural wall strength uniformity in the tube over its zones of varying and offset configuration, even though a portion of the tube has significant transverse offset.

The novel method and apparatus allows for the reduction and/or elimination of preforming the tubular workpiece prior to hydroforming, i.e., bending, sizing, etc. In addition, this innovation allows for an improvement in the formability of the metal, i.e., increasing elastic/elongation properties, and therefore potential for the removal/elimination or reduction of heat treating with annealing.

The novel method and apparatus are capable of reconfigurating a tube into a complex shape having substantial transverse offset zones, yet achieving relatively exact target dimensions and desired cross sectional shape to suit the particular installation.

The novel apparatus for reconfigurating a tubular workpiece comprises upper and lower tool sections or subassemblies mounted to upper and lower press platens, defining therebetween a cavity which is elongated in an axial dimension, transversely configurated to form offset zones, and open on its axial ends, to receive an axially elongated tubular workpiece in the elongated cavity. The upper and lower tool sections are movable vertically together or apart, and each is formed of a plurality of tool segments movable axially into engagement with each other, or spaced from each other, i.e., in the axial dimension, and vertically movable independently. A pair of tapered mandrels adjacent the axial open ends of the elongated cavity flare and retain a tubular workpiece therebetween for sealed closure of the ends of the tubular workpiece in the elongated cavity, for forcing workpiece material axially inwardly during mechanical offset forming of the workpiece, and for entry of hydroforming liquid into the workpiece for hydroforming the configurated workpiece to the final target configuration. Means are provided for forcefully shifting the endmost upper and lower tool segments into engagement with each other to grip the ends of the workpiece, and for forcefully axially shifting the mandrels and the segments toward each other to sequentially engage a tubular workpiece, flare its ends against these endmost tool segments, compress the tube axially while the remaining upper and lower tool segments are moved vertically together to offset-reconfigure a tubular workpiece by the tool sections, and while the workpiece is subsequently hydroformed to its final configuration. Hydroforming fluid supply and pressurizing means are operably associated with the mandrels for controllably hydroform-expanding the reconfigured tubular workpiece in the elongated cavity to the specific shape of the cavity. A pair of annular, axially-inwardly extending tool locking rings are spaced radially outwardly of the mandrels. Each of the endmost upper and lower tool segments has semi-annular, axially-outwardly extending elements, to be on both axial ends of the tool subassemblies, to cooperatively form annular lockable rings when the tool is closed on itself, the annular rings having an outer diameter substantially equal to the inner diameter of the tool locking rings for interfit therewith, to positively lock the upper and lower segments of the tool together during flaring and subsequent hydroforming.

A novel method of offset reconfigurating an elongated tubular workpiece is disclosed which comprises the steps of providing a pair of upper and lower tool sections or subassemblies made up of segments and independently vertically movable together to define an axially elongated configurated cavity therebetween having open axial ends, and means for forcing the tool sections together to transversely mechanically deform a tubular workpiece in the cavity, the tool being formed of axially movable tool segments movable axially into engagement with each other or spaced from each other, providing spaced stops to temporarily retain the tool segments axially spaced, providing a pair of workpiece flaring and retaining mandrels at the axial ends of the cavity. These end segments are vertically engaged prior to the middle segments coming into contact with the tubular workpiece. While retaining the elongated tubular workpiece between the mandrels in the elongated cavity, the method includes flaring the ends of the workpiece, filling the workpiece with fluid, lowering the upper tool subassembly toward the lower tool subassembly while axially moving at least one of the mandrels toward the other mandrel for moving the tool segments axially toward each other, to mechanically deform the workpiece transversely of the cavity axis while axially compressing the workpiece for supplying workpiece material to the offset zones, and then increasing pressure on the fluid in the workpiece sufficient for hydrodynamically expanding the workpiece to the specific form of the elongated tool cavity. The step of flaring the ends of the workpiece with the mandrels, and subsequently retaining the tubular workpiece, includes clamping the workpiece near the ends thereof prior to flaring the ends of the workpiece, while stopping the endmost tool segments from moving axially together during the flaring step. Also, the closed, endmost segments of the upper and lower tool subassemblies are retained locked together by locking rings prior to the step of hydrodynamically expanding the workpiece.

Apparatus for both mechanical forming and hydroforming is understood to be known technology. The use of tapered mandrels to flare the ends of tubes to be hydroformed is also understood to be known, as is the axial feeding in of tube stock during formation of the tube. The present invention provides unique sequential gripping and offset forming by individual tool segments which are held spaced from each other while sequentially vertically shifting to offset deform, and then caused to move together axially while hydroforming within the forming cavity. The apparatus and method employ this unique independent vertical segment action as well as primary stops and secondary stops for the segments, locking collars keeping the tool assemblies closed during flaring and hydroforming, and controlled segment separation for finished part removal.

These and other objects, advantages and features of the invention will become apparent upon studying the following specification in conjunction with the drawings.

DESCRIPTION OF THE PREFERRED EMBODIMENTS

Figure 1:
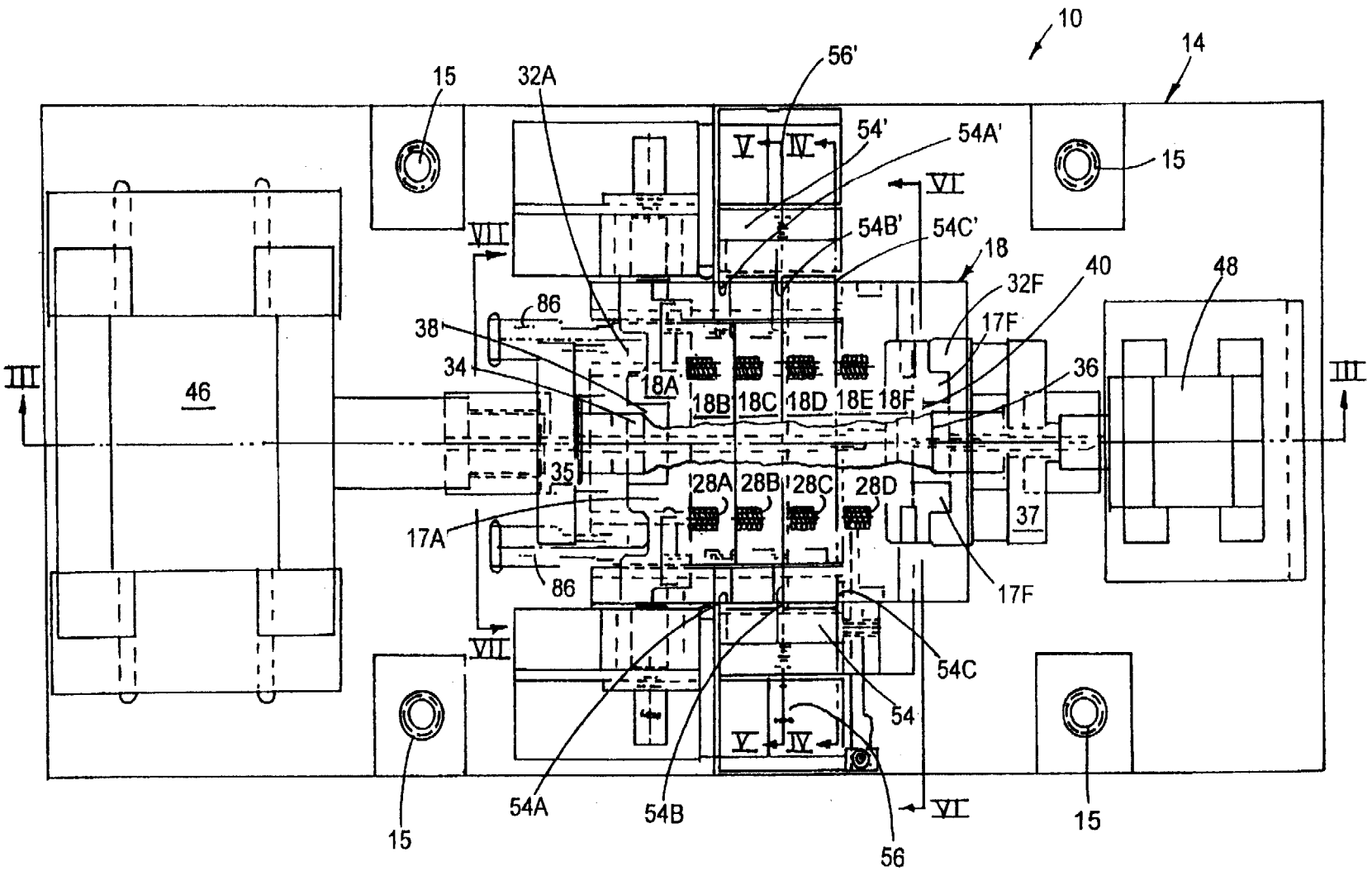
FIG. 1 is a plan view of a lower tool section in a press assembly according to this invention and comprised of lower tool segments.

Referring now specifically to the drawings, the apparatus 10 is shown to include an upper press platen 12 and a lower press platen 14, both mounted on four vertical, corner guide rods 15, the upper platen to be vertically movable thereon, to move the platens together or apart. Conventional fluid cylinder means represented by arrow 11 (FIG. 3) can act to close the press while the lower platen will normally be held fixed. The platens have therebetween a tool assembly which includes an upper tool section or subassembly 16 mounted on upper platen 12 and a lower tool section or subassembly 18 mounted on lower platen 14, the two tool subassemblies being configured in complementary fashion to be cooperative with each other to deform a tubular workpiece therebetween to a new configuration with transversely offset zones.

Figure 2:
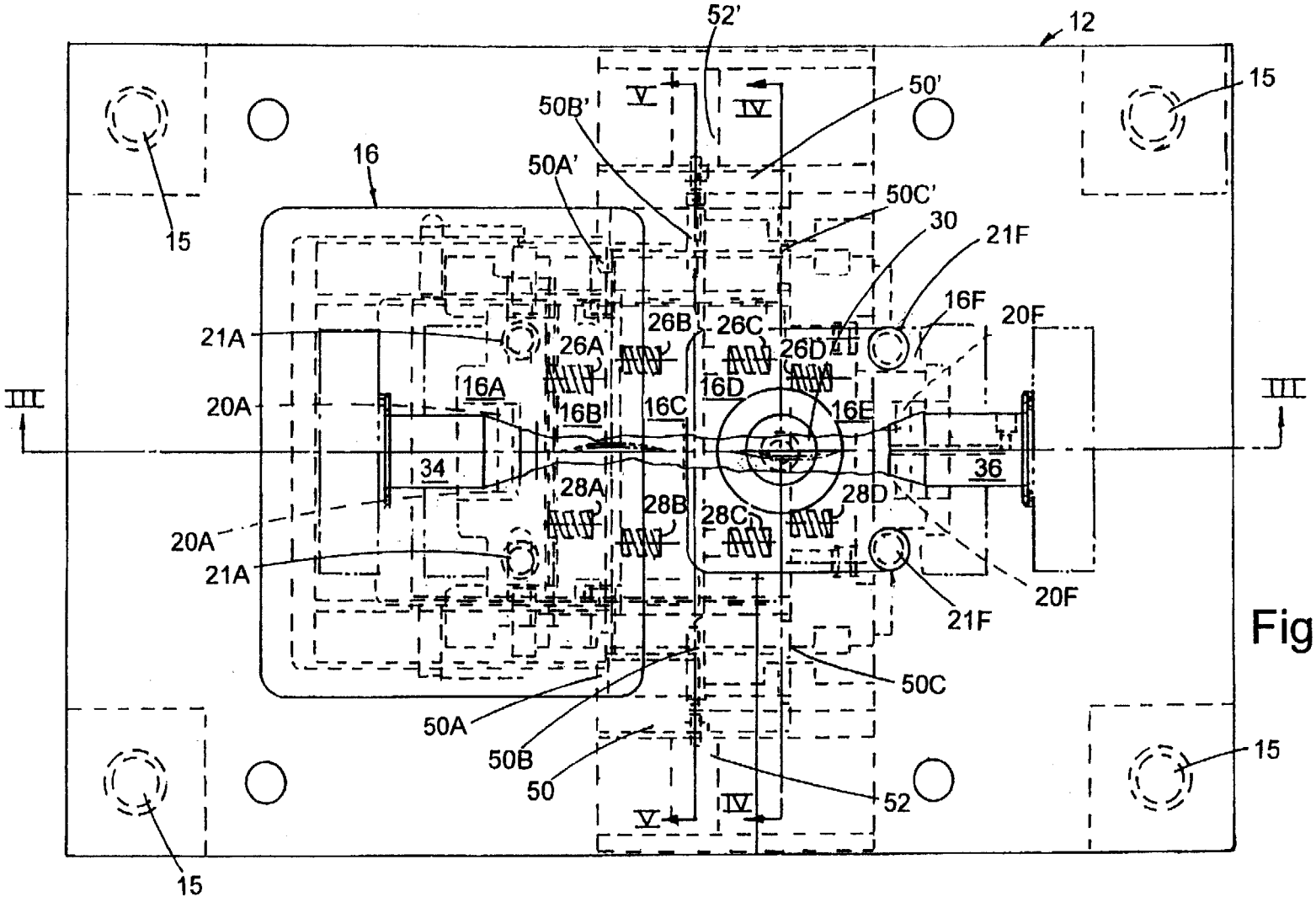
FIG. 2 is a plan view of the upper tool section comprised of upper tool segments.
Figure 3:
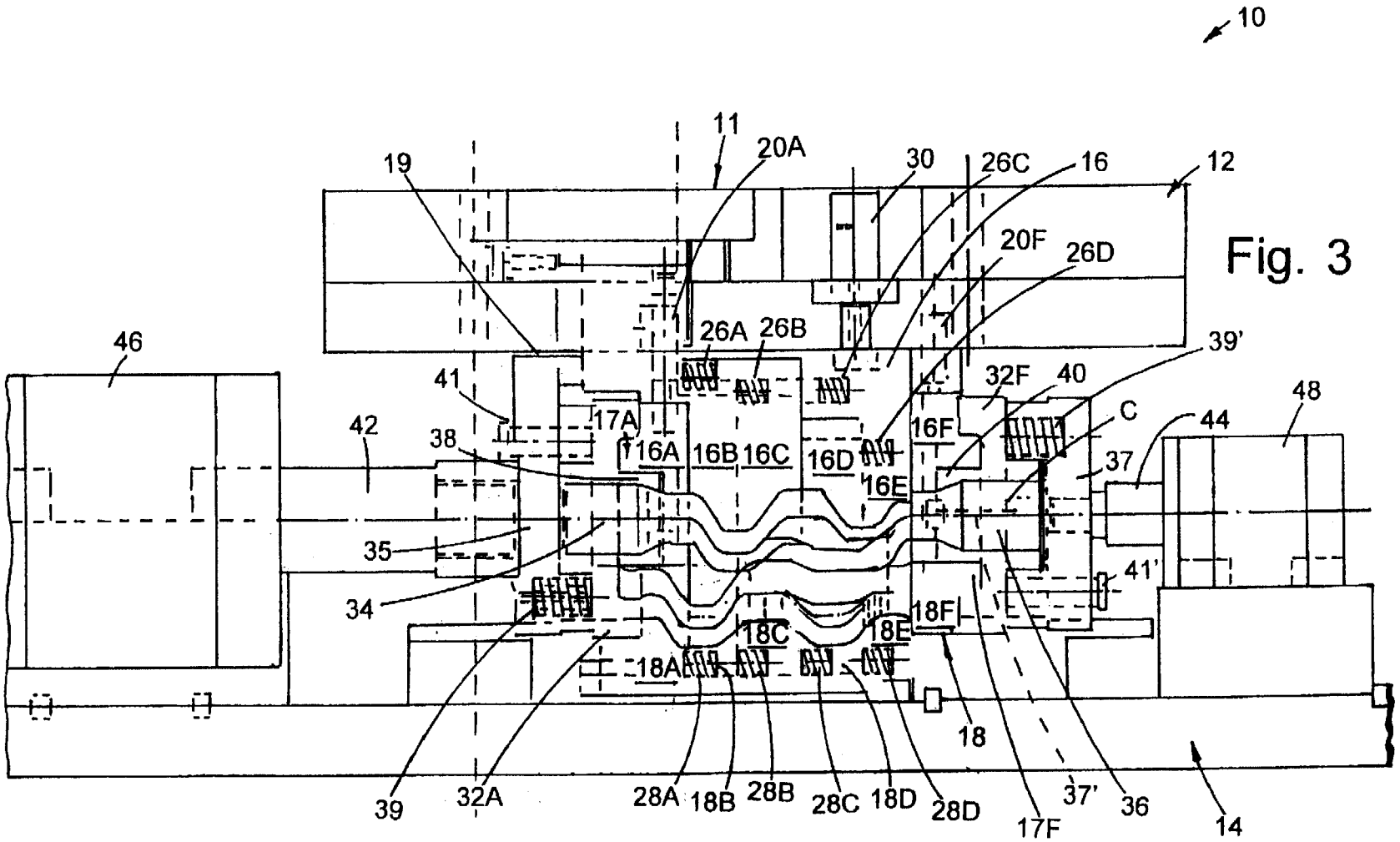
FIG. 3 is a sectional view taken on plane III—III of FIGS. 1 and 2.
Figure 4:
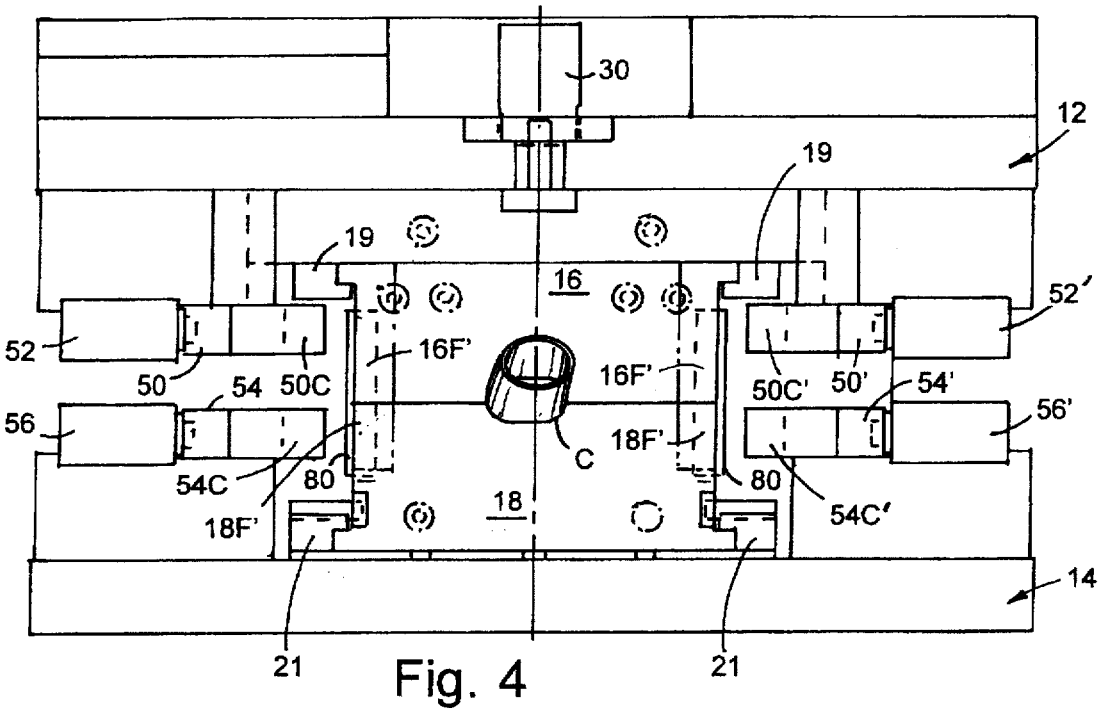
FIG. 4 is a sectional view taken on plane IV—IV of FIGS. 1 and 2.
Figure 5:
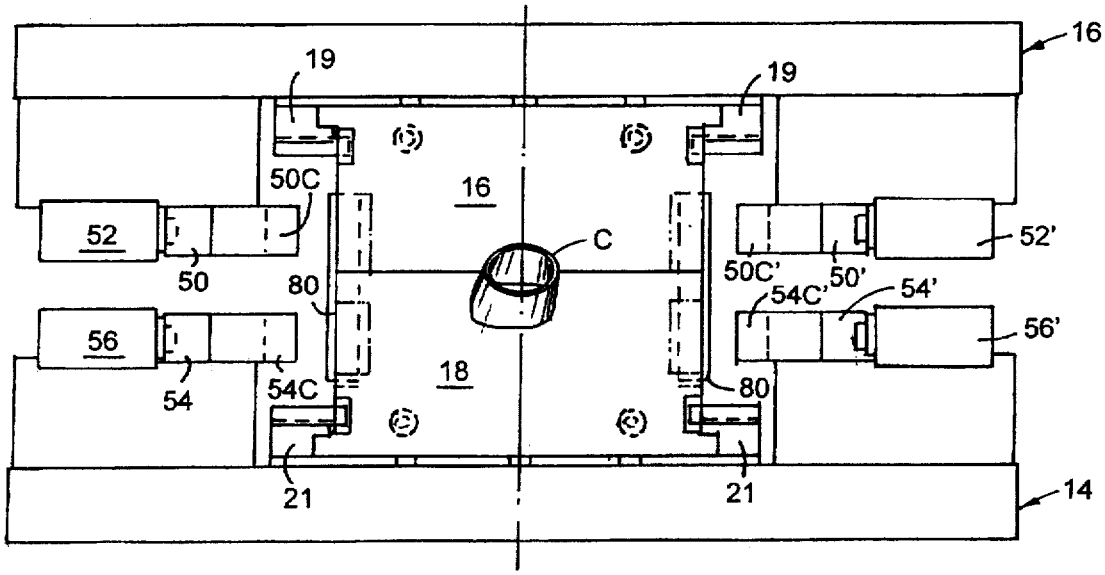
FIG. 5 is a sectional view taken on plane V—V of FIGS. 1 and 2.
Figure 10:
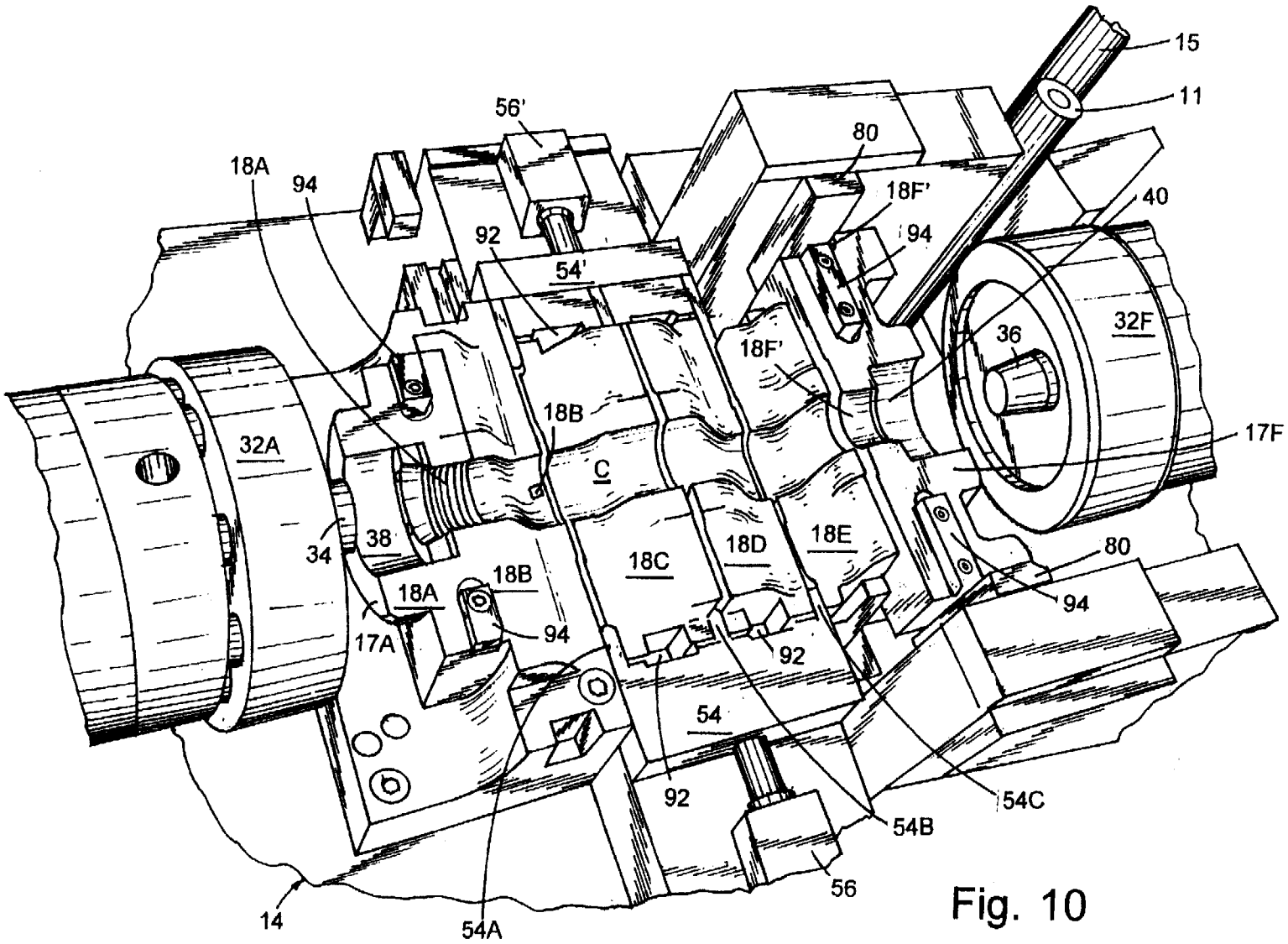
FIG. 10 is another perspective view of the lower tool section and actuator assembly in FIG. 8.
Figure 12:
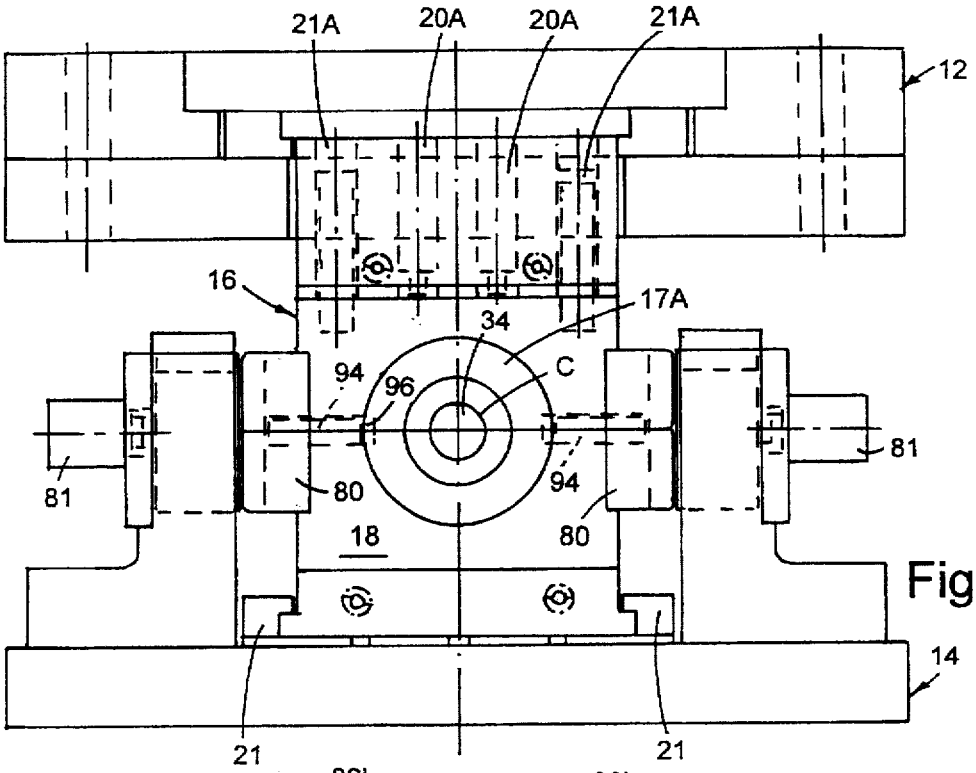
FIG. 12 is an elevational view of a portion of the tool assembly including the upper and lower tool sections, viewing from the right end of FIG. 1.
Figure 17:
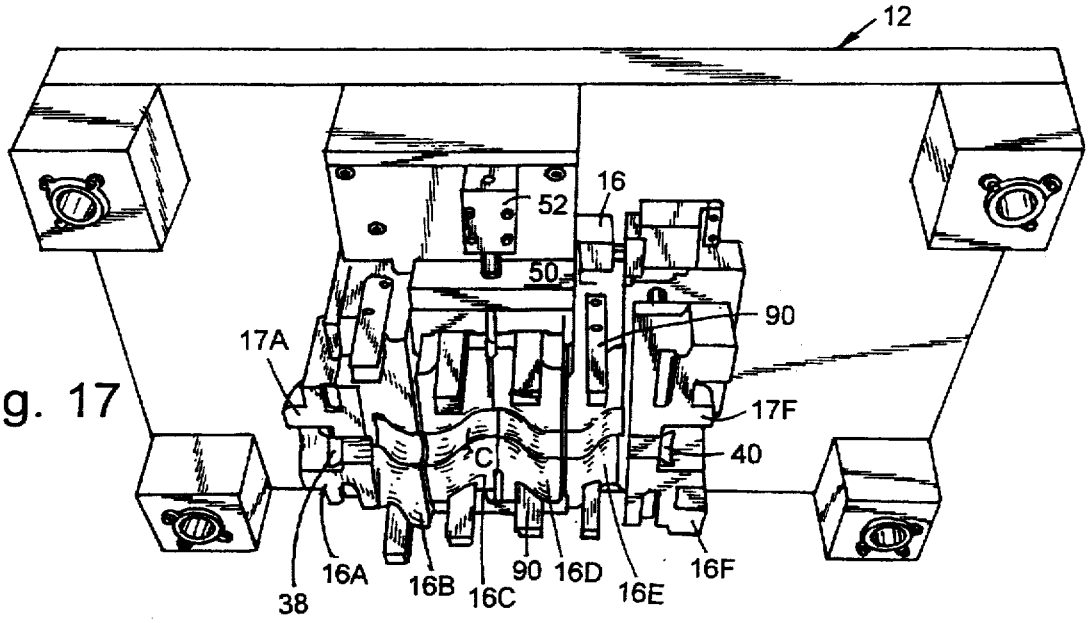
FIG. 17 is a perspective view of the underside of the upper tool subassembly.

The upper tool subassembly 16 is segmented to comprise a plurality of axially adjacent tool segments (FIG. 3), here shown to be six in number (FIG. 17), such comprising endmost segments 16A and 16F, and intermediate segments 16B, 16C, 16D and 16E (FIG. 17). End segments 16A and 16F are fixed to the upper platen. The others of these tool segments are movable axially, i.e., in the direction parallel to the axis of the workpiece and workpiece cavity, toward segment 16A, into interengagement with it and each other, or alternatively moved away from segment 16A and each other to a spaced apart condition out of engagement with each other. This movement is on a gib slide 19 (FIG. 4) of the upper platen, while suspended from the upper platen on this slide. A nitrogen spring, i.e., gas cylinder spring 20A (FIG. 3), is positioned vertically in cavities between platen 12 and tool end segment 16A. A like nitrogen spring, i.e., gas spring 20F, is positioned between platen 12 and the opposite end segment 16F (FIGS. 2 and 3). These gas springs 20A and 20F bias the two end upper tool segments 16A and 16F downwardly as guided by shafts 21A and 21F (FIGS. 2 and 12) toward the end tool segments 18A and 18F of the lower tool subassembly during lowering of the upper platen, to be the first segments to engage and hold the workpiece ends before the central segments of the form tool sections come together, and before the subsequent flaring of the ends of the workpiece. The semicylindrical cavities of segments 16A and 16F are machined to be the diameter of the raw tube, e.g., 18A' and 18F' (FIG. 10) to thereby tightly grip the tube end portions when segments 16A and 16F are lowered to engage the underlying cooperative lower tool segments 18A and 18F.

A plurality of compression coil springs 26A, 26B, 26C and 26D are axially positioned between the segments of the upper tool subassembly 16 for applying a bias tending to force the segments apart. Specifically, springs 26A are between segments 16A and 16B, 26B are between segments 16B and 16C, 26C are between segments 16C and 16D, and 26E are between segments 16D and 16E.

The lower tool subassembly is also segmented, having the same number of segments as the upper tool, and here shown to be in six segments 18A, 18B, 18C, 18D, 18E and 18F (FIG. 3). Segment 18A is fixed to the lower platen while the rest of these lower segments are slidably mounted on lower gib slide 21 (FIG. 4) to be movable into engagement with each other and segment 18A, or apart from each other to be spaced. Compression coil springs 28A, 28B, 28C and 28D are located between the respective segments to apply a bias tending to push them apart. Springs 28A are between segments 18A and 18B, springs 28B are between 18B and 18C, springs 28C are between 18C and 18D, and springs 28D are between 18D and 18E.

Figure 8:
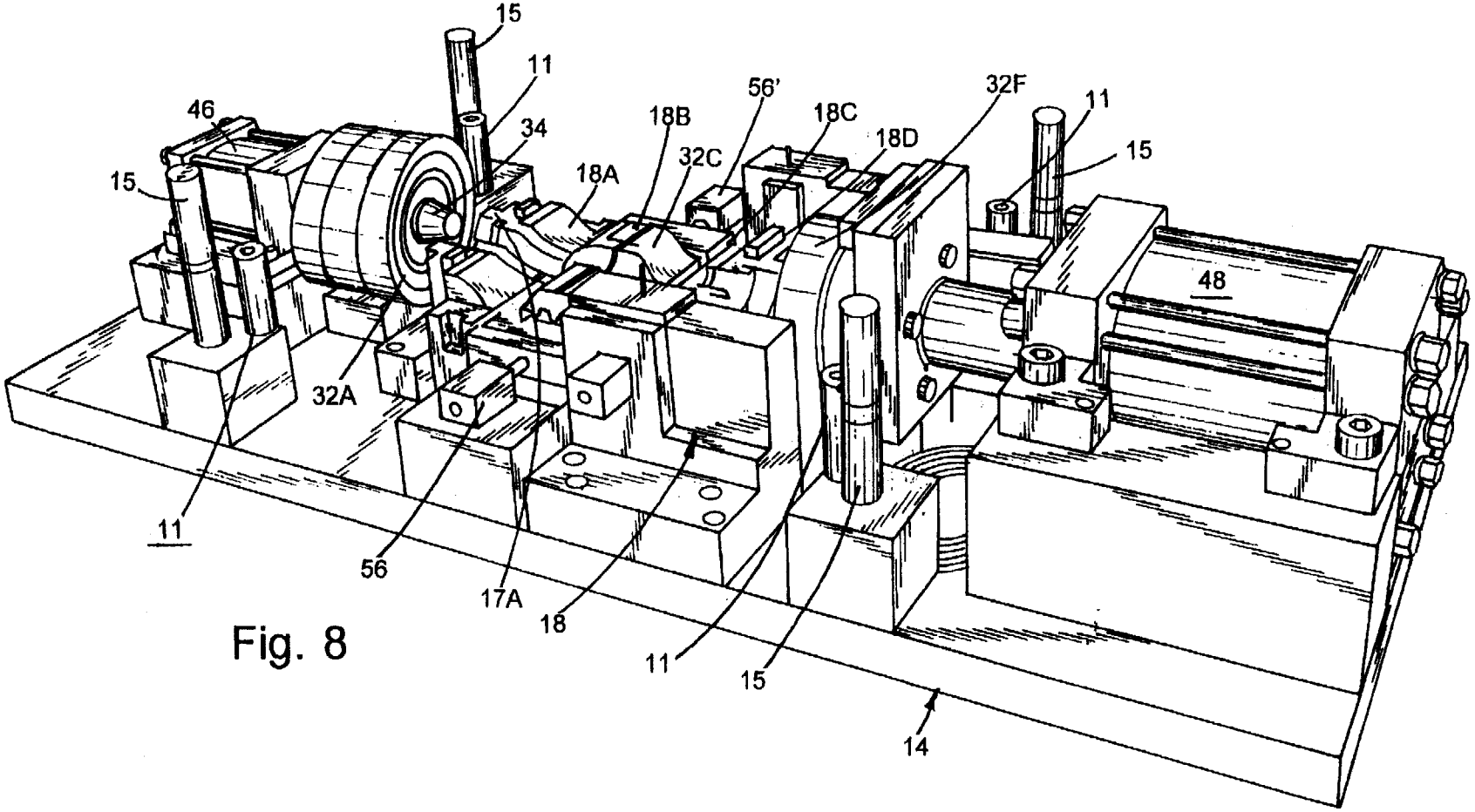
FIG. 8 is a perspective view of the entire lower tool section and actuator assembly.
Figure 9:
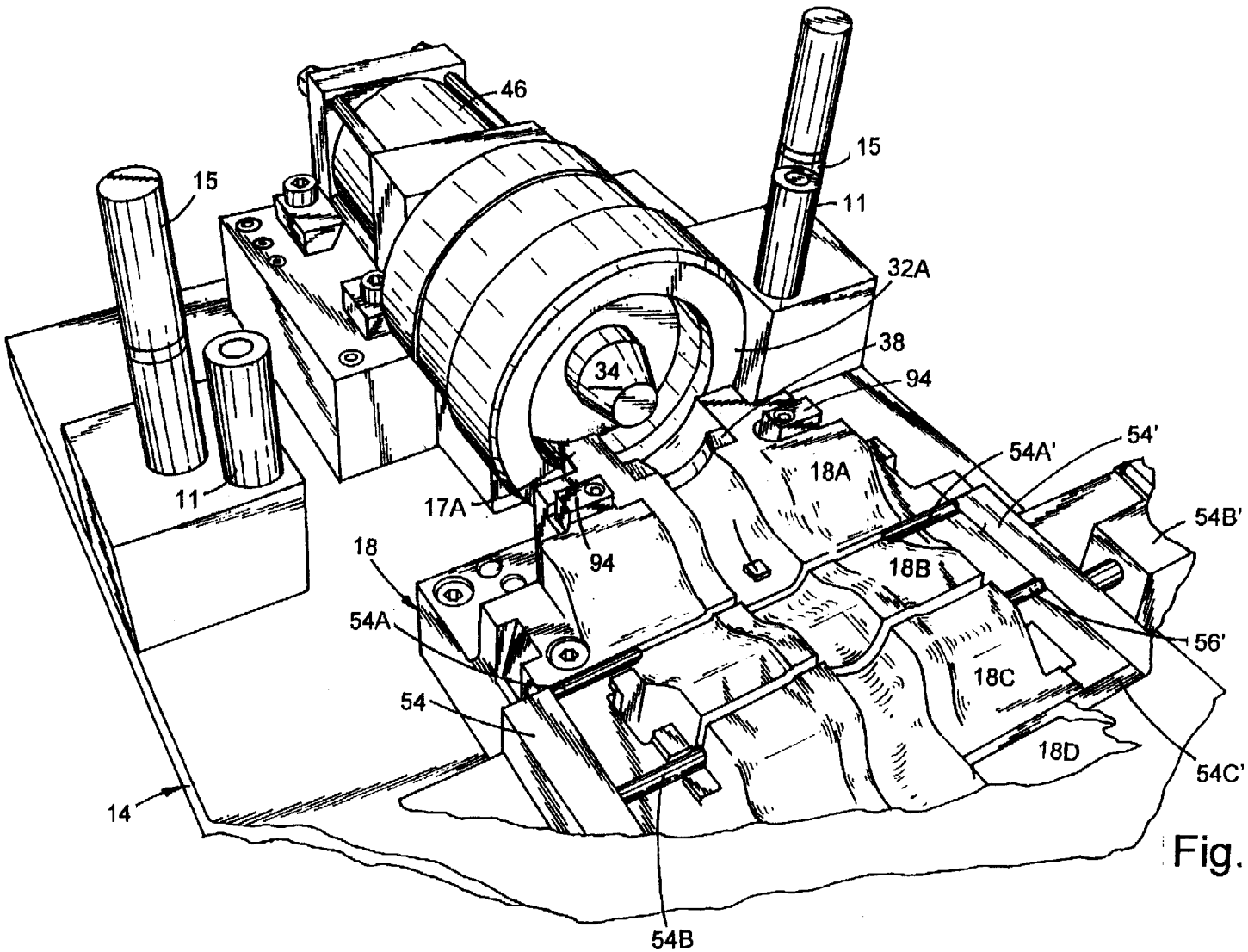
FIG. 9 is a fragmentary perspective view of the left end of the lower tool section and actuator assembly in FIG. 8.

The cooperative subassemblies 16 and 18 define therebetween an axially elongated, transversely offset configurated form cavity C which is open at its opposite axial ends. In the specific embodiment depicted, this cavity has two primary portions, i.e., from the middle to one end and from the middle to the opposite end, each of which has a significant transverse offset. This allows a double tube to be formed and later cut in two in the middle, to result in two tubes. Hence, for reasons and in a manner to be explained hereinafter, when the workpiece ends are gripped by end segments 16A and 18A, and 16F and 18F respectively, and flared, each half of the elongated cavity is then vertically actuated independently to first mechanically offset deform one end, i.e., the right end (as viewed in FIG. 3), of a workpiece in the cavity C, and then offset deform the other end, i.e., the left end, of the workpiece, as the workpiece is pushed axially from left to right (as viewed), to feed workpiece material to the zones being offset deformed. A hydraulic spring, i.e., preform fluid cylinder 30, is vertically positioned between upper platen 12 and tool segments 16D and 16E so as to shift these two tool segments 16D and 16E vertically downward to begin forming and offset the one end of the double tube prior to vertical shifting of segments 16B and 16C on the opposite half of the subassembly for the preforming and offsetting of the second end of the double tube, in a manner to be described hereinafter. Segments 16B and 16C are subsequently shifted vertically downwardly by platen 12 itself. The downward movement of platen 12 is ultimately limited as by four corner stops 11 (FIGS. 8 and 9) extending up from lower platen 14 and full engagement of the upper and lower tool subassemblies 16 and 18 (FIG. 3).

The outer ends of both upper tool segment 16F and lower tool segment 18F have semiannular and semicylindrical, axially outwardly protruding half elements of a lockable ring so as to cooperate to form an annular lockable ring 17F (FIG. 3). Similarly, at the opposite end, the upper tool segment 16A and lower tool segment 18A have like semiannular and semicylindrical, axially outwardly projecting half elements of a lockable ring to cooperatively form in combination a second annular lockable ring 17A. These oppositely projecting cylindrical lockable rings 17A and 17F on opposite ends of the tool subassemblies cooperate with a pair of annular locking rings 32A and 32F which have an internal diameter matching the external diameter of lockable rings 17A and 17F. The locking rings 32A and 32F are axially shiftable toward the endmost tool segments and over the annular lockable rings 17A and 17F to securely hold closed upper tool segments 16A and 16F and lower tool segments 18A and 18F during the workpiece end flaring step and during subsequent high pressure hydroforming of the workpiece, as described hereinafter.

Figure 6:
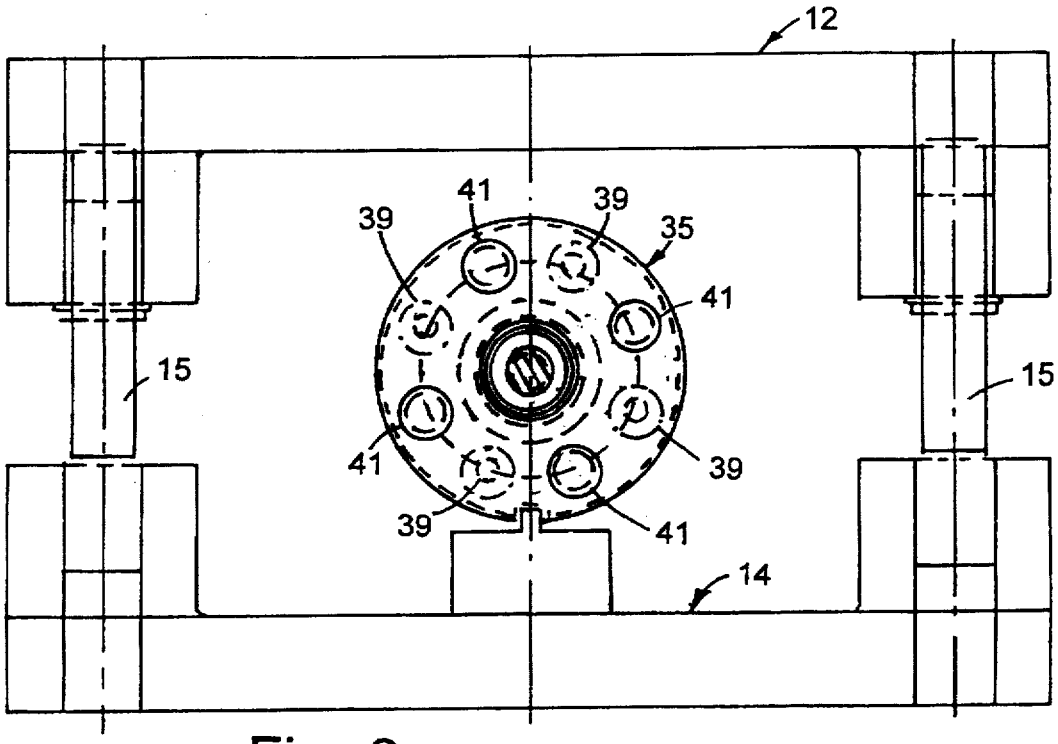
FIG. 6 is an end sectional view of the mandrel and surrounding locking ring on the right end of the apparatus as viewed in FIG. 1.
Figure 7:
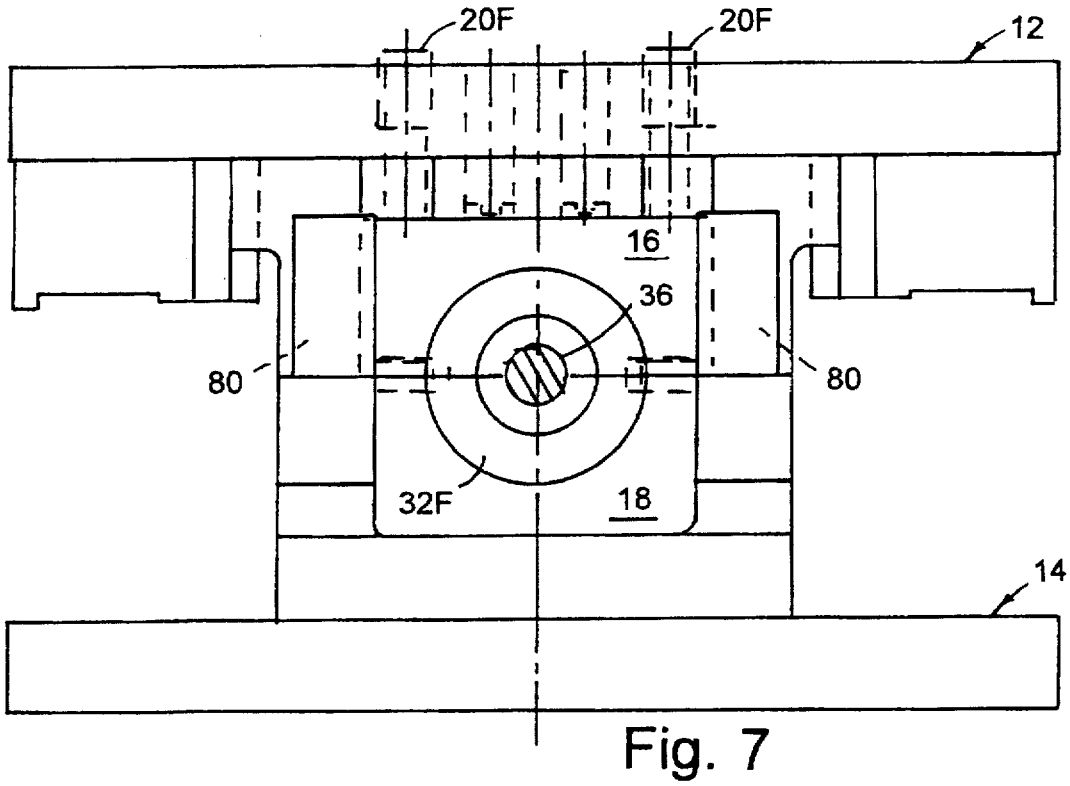
FIG. 7 is an end sectional view of the mandrel and surrounding locking ring on the left end of the apparatus as viewed in FIG. 1.
Figure 13:
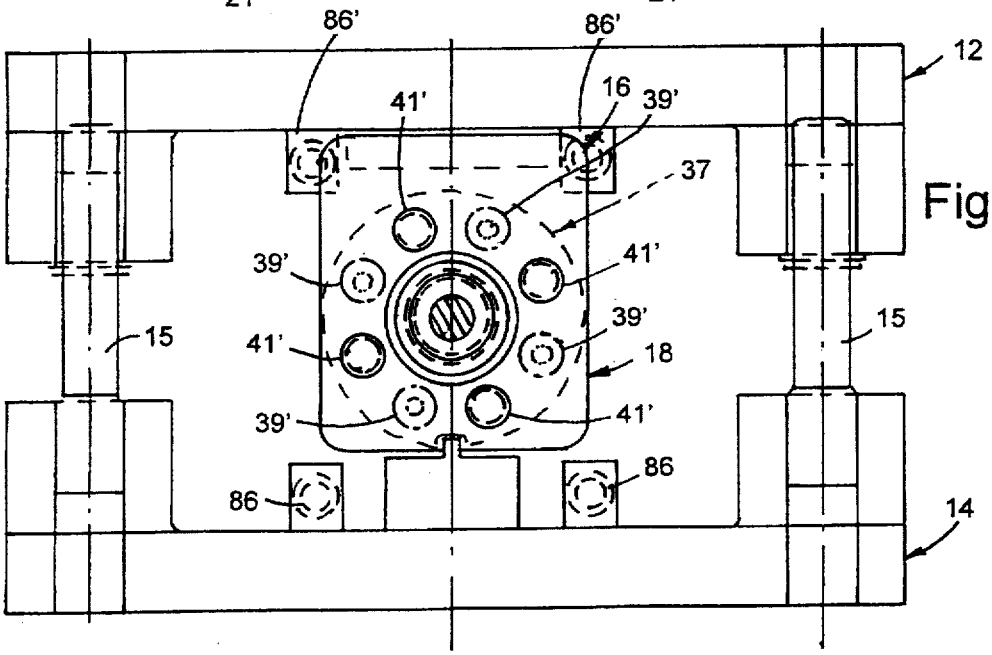
FIG. 13 is an end sectional view of the apparatus, similar to FIG. 6 but showing some different elements.

Locking rings 32A and 32F surround and are spaced from a pair of axially shiftable, tapered, workpiece-flaring and retaining mandrels 34 and 36. Locking ring 32A and mandrel 34 are both mounted on and extend axially from hub 35. Locking ring 32F and mandrel 36 are both mounted on and extend axially from hub 37 (FIG. 1). These mandrels 34 and 36 have frustoconically tapered outer ends extending toward the tool subassemblies and basically matching cooperative, frustoconically tapered sleeves 38 and 40, respectively on the end elements 16A and 18A and end elements 16F and 18F of the tool segments. These mandrels and sleeves are preferably tapered at about a 20° angle. This interfit between the mandrels and sleeves enables the mandrels to outwardly flare the ends of a tubular workpiece W placed in cavity C, as well as subsequently seal and retain the workpiece in fluid tight condition during mechanical offset forming and subsequent hydroforming of the workpiece, in the manner to be described. Hubs 35 and 37, mandrels 34 and 36 and the surrounding locking rings 32A and 32F are axially movable at the ends of shafts 42 and 44, respectively, extending from piston rods (not shown) in conventional fluid cylinder actuators 46 and 48, respectively. Both fluid cylinders are axially actionable toward each other a fixed amount to shift mandrels 34 and 36 into the open ends of a tubular workpiece to flare these ends against sleeves 38 and 40, and form a tight seal at these sleeves with the ends of the workpiece therebetween. These cylinders also shift the locking rings 32A and 32F with the mandrels to slide the locking rings over lockable rings 17A and 17F. There is controlled lost motion action between the mandrels (FIG. 1) and their respective surrounding locking rings. This is controlled by sets of cooperative compression springs and shoulder pins between each mandrel and its locking ring. Specifically, in FIGS. 1, 3 and 6 are shown four axially oriented, circumferentially spaced compression springs 39 on hub 35, with four axially oriented, circumferentially spaced shoulder pins 41 in alternating position therewith. The springs serve to extend, i.e., spread, the locking ring relative to the mandrel, while the shoulder pins serve to limit this lost motion of the locking ring relative to the mandrel, providing a fixed length of mandrel retraction prior to the ring being pulled from engagement with segments 17A and 17F. Therefore, the mandrel can be retracted a small amount prior to ring retraction releasing the tool segments after the hydroforming step, to break the seal to the workpiece. Similarly, in FIGS. 1, 3 and 13 are shown the four springs 39' and four shoulder pins 41' for the other hub 37. These function in the same manner.

After the workpiece ends are flared and sealed, the workpiece is filled with liquid for stabilizing the workpiece during mechanical offset deformation, and to serve as the medium during hydroforming steps. This liquid, e.g., water, is injected through a passageway 37' (FIG. 3) through one of the mandrels, here 36. Cylinder 48 is then not shiftable further since tool segments 16A and 18A are not axially movable. This end remains fixed during the subsequent steps. However, cylinder 46 is subsequently further axially actionable toward the cavity to force workpiece material axially into the offset work zone as needed for the transverse deforming to take place, and also to axially force the upper and lower tool segments together prior to hydroforming. The liquid stabilizes the workpiece during mechanical forming, and subsequently allows the liquid to be put under ultra high pressure for hydroforming. When the offset portions are mechanically forced into the workpiece, a flat sensor-mounting zone is formed at the offset part of the tube by having a flat pattern, e.g., 18B, (FIG. 9) in the forming cavity C. This zone enables a gas sensor to be mounted on the top of an exhaust pipe from a vehicle engine in a vehicle, for monitoring the gaseous contents of the exhaust, particularly oxygen content. This is important for pollution control.

During the flaring step, it is necessary that the end segments 16A, 18A, 16F and 18F be secure. Segments 16F and 18F are axially fixed to the lower platen, so that they are already secure. In order to fix segments 16A and 18A, a pair of laterally positioned end stops 80 (FIG. 10), called primary stops, are transversely shiftable by actuators 81 (FIG. 12) toward the workpiece and elongated cavity C, to move into a recess axially behind shoulders of segments 16A and 18A (FIGS. 4 and 10) on opposite sides of tool segments 16A and 18A, to prevent segments 16A and 18A from shifting axially under the axial force of the flaring action. Each stop 80 could be composed of two vertically separated stops, each with its own actuator.

In addition, the four central segments of each of the upper and lower tool subassemblies can be prevented from moving together from their spaced condition by transversely shiftable stops that have three stop fingers to extend between the four tool segments. These are designated as secondary stops. Specifically, the center four upper tool segments can be retained in spaced apart condition by stop fingers 50A, 50B and 50C (FIG. 18) which project on one side from a common support 50 shiftable with its fingers toward or away from upper tool assembly 16 by the piston rod of a fluid cylinder 52. A similar set of stop fingers 50A', 50B' and 50C' mounted on support 50' and actuated by cylinder 52' are on the opposite side of the upper tool subassembly. Shifting of the respective fingers between the segments on both sides prevents the tool segments from moving axially toward or into engagement with each other until desired. Retraction of the fluid cylinders shifts, i.e., retracts, the stop fingers out of the upper tool subassembly. In similar manner, a plurality of three fingers 54A, 54B and 54C, mounted on a common support 54 and actuated by a cylinder 56, are shiftable between the four central tool segments of the lower tool subassembly on one side, while similar stop fingers 54A', 54B' and 54C' are mounted on a common support 54' and actuated by a cylinder 56' on the opposite side of the lower tool subassembly. Shifting of the fingers of these cooperative mechanisms between the central segments of the lower tool subassembly prevents the segments from moving axially into engagement with each other until it is desired, at which time the stop fingers are withdrawn outwardly by the fluid cylinders to the retracted positions shown, for example, in FIG. 4.

Figure 14:
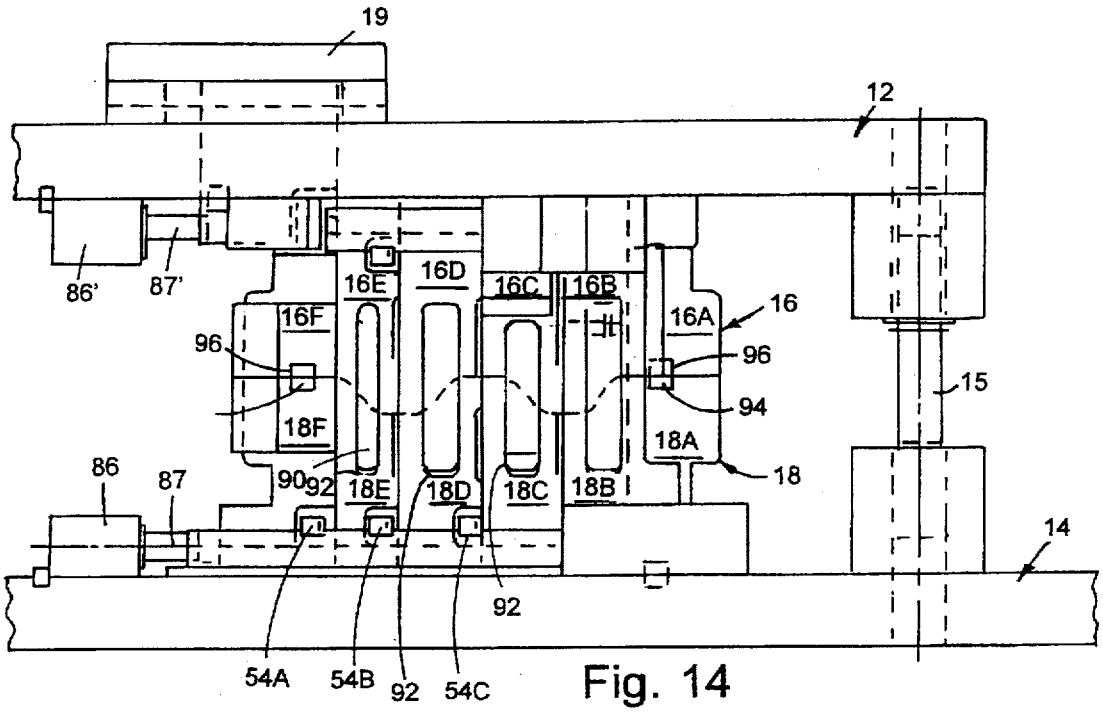
FIG. 14 is a front elevational view of the upper and lower tool apparatus in fully closed position, both vertically and axially.
Figure 18:
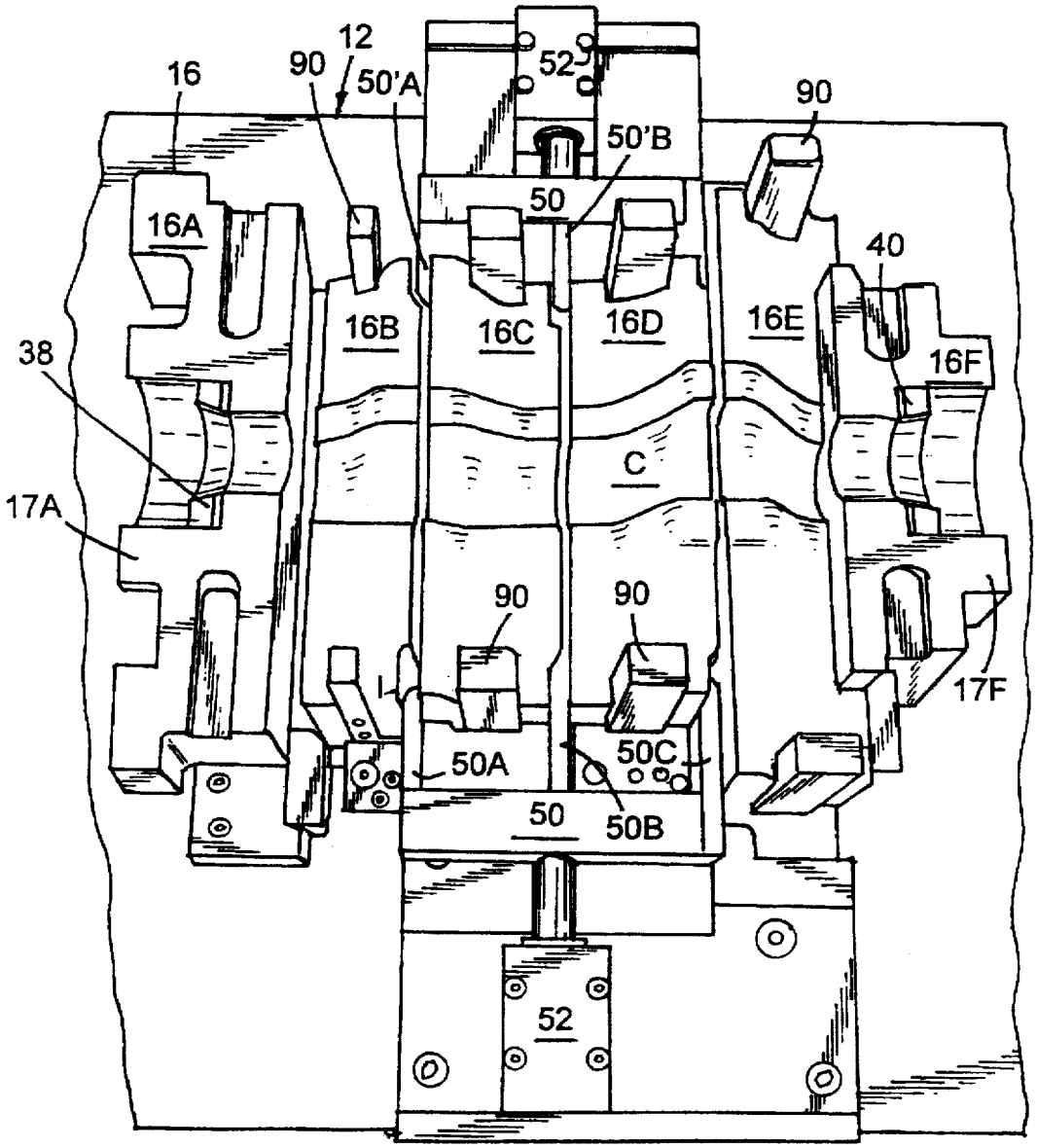
FIG. 18 is another perspective view of the upper tool subassembly from a different angle.
Figure 19:
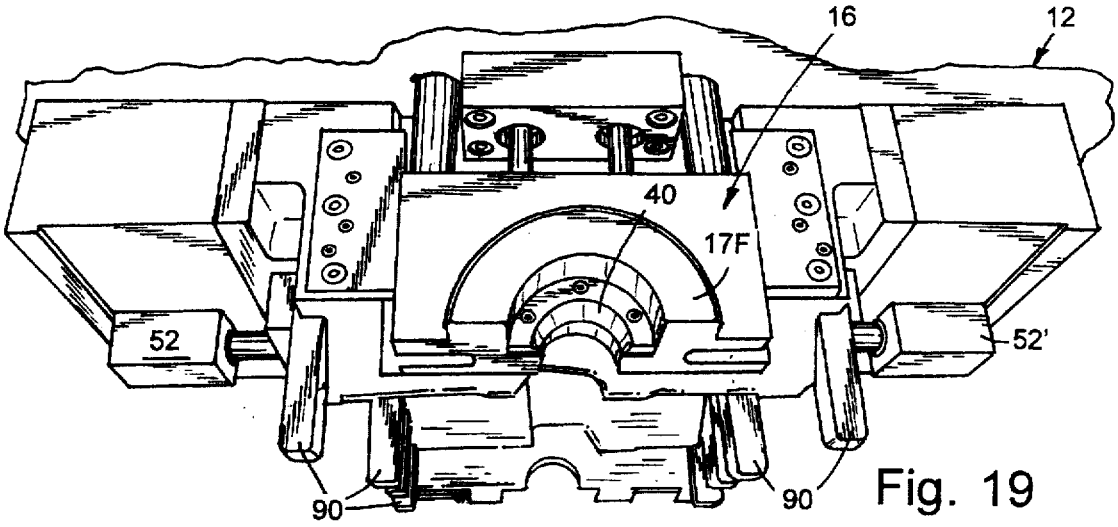
FIG. 19 is an end perspective view of the upper tool assembly.
Figure 20:
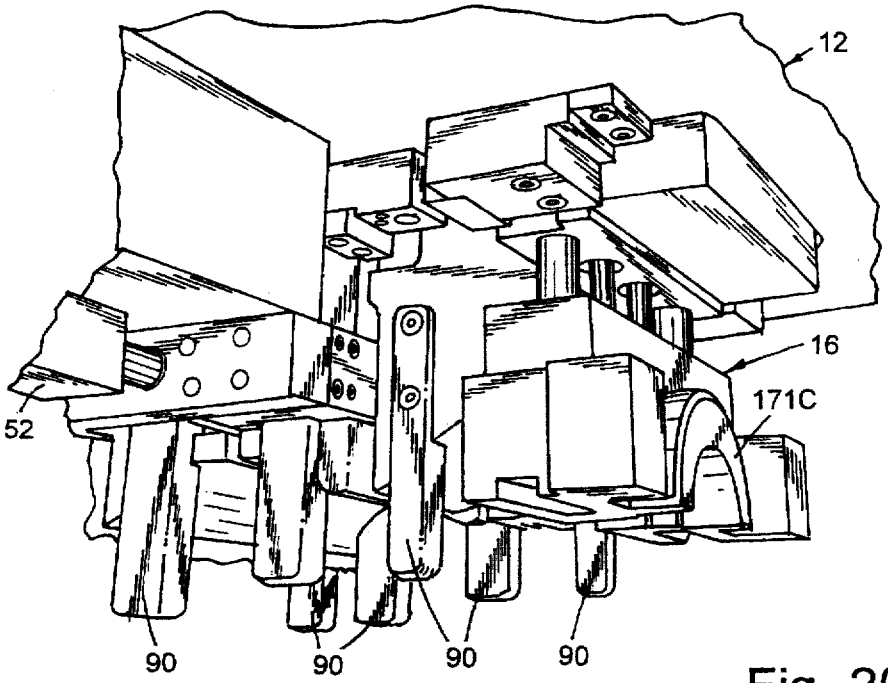
FIG. 20 is a fragmentary perspective view showing the primary stop end and part of one side of the upper tool subassembly.

In order to assure accurate alignment between the upper tool subassembly and the lower tool subassembly, a series of elongated, vertical guide fingers 90 project down from the upper tool subassembly to slide into like configurated elongated sockets 92 in the lower tool subassembly (FIGS. 14, 17 and 18). Also, there are tapered transverse keys 94 on lower tool segments 18A and 18F (FIGS. 10 and 14) which fit into like configurated slots 96 in the upper tool segments 16A and 16F (FIG. 14).

Figure 11:
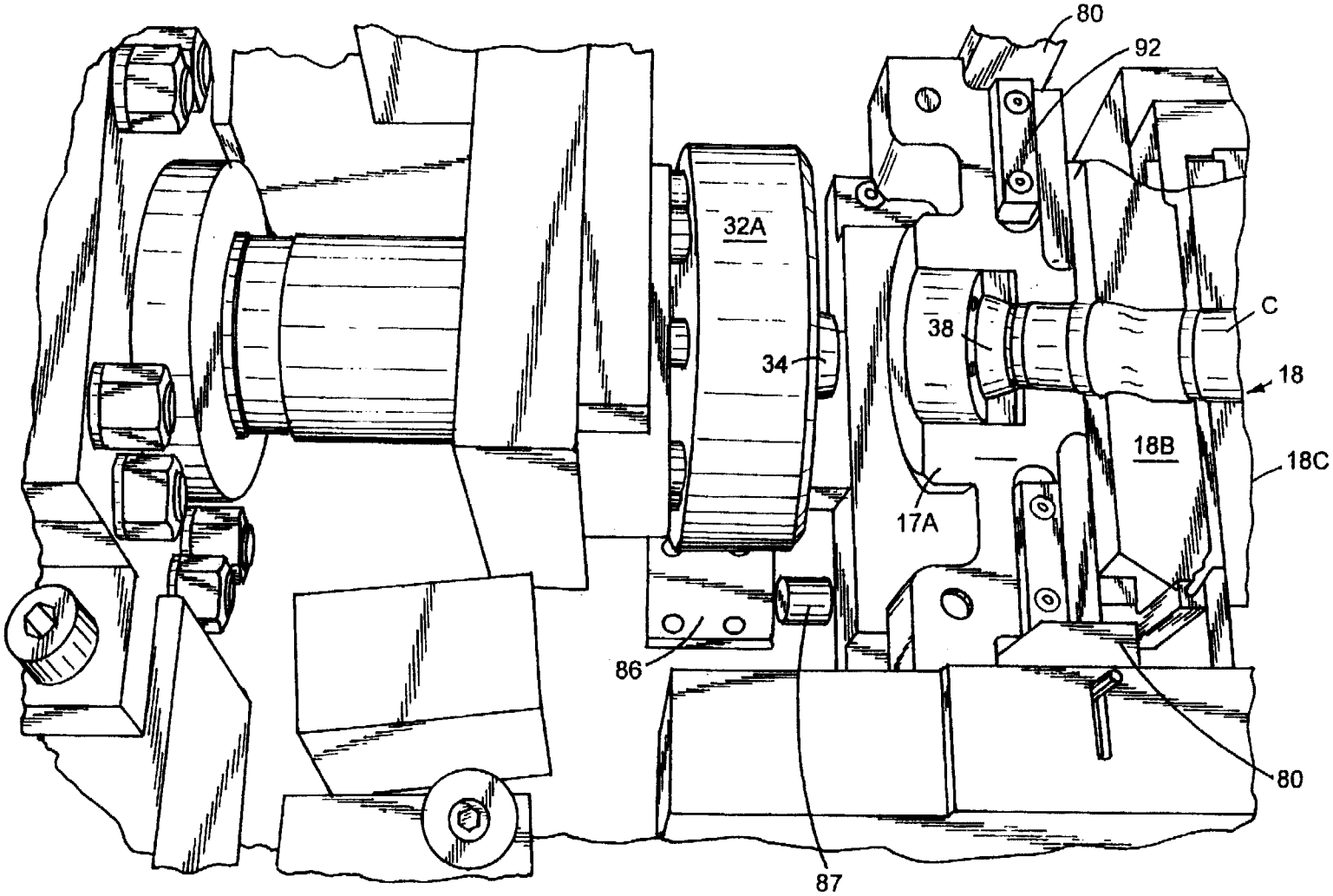
FIG. 11 is a fragmentary perspective view of the left end of the lower tool and actuator assembly.
Figure 15:
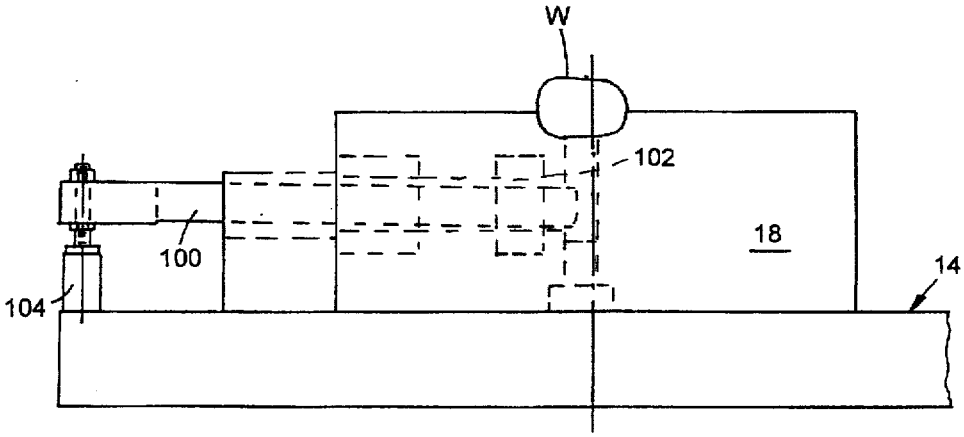
FIG. 15 is a fragmentary elevational view depicting the workpiece lifter, i.e., part ejector portion, of the assembly.
Figure 16:
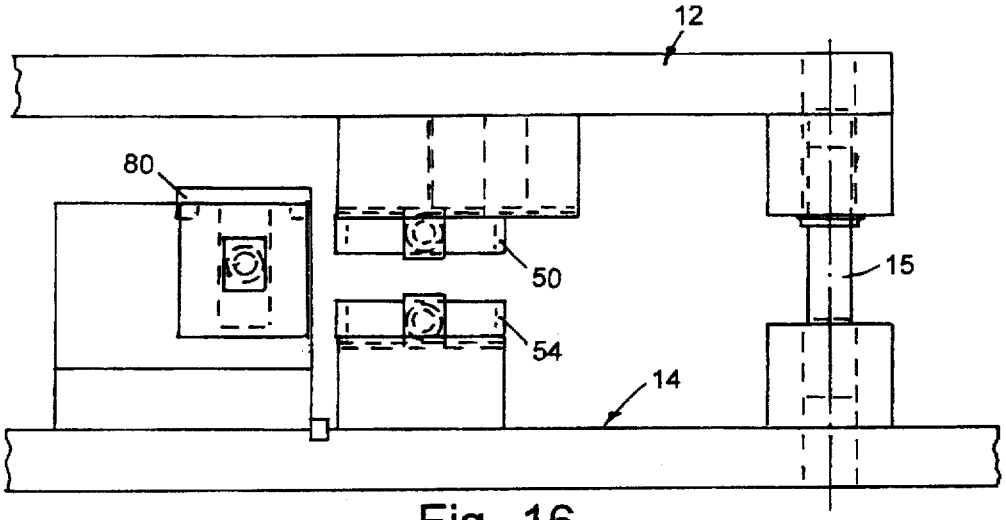
FIG. 16 is a partial elevational view of the press assembly detailing primary and secondary stops.

On the lower platen 14, adjacent tool segment 18F, is mounted a pair of fixed, releasable, fluid cylinder restraining stops 86 (FIGS. 14, 13 and 11) with axially extended shiftable piston rods 87 positioned to be engaged by the outer face of tool segment 18F. On upper platen 12 adjacent tool segment 16F is a similar pair of fixed, releasable, fluid cylinder restraining stops 86' with axially extended shiftable piston rods 87' positioned to be engaged by tool segment 16F. When pressure is released from the workpiece and tool segments by mandrels 34 and 36, the compression coil springs between the tool segments apply a significant separating force. These restraining stop elements prevent immediate tool segment separation which could cause the finished workpiece to bind in the cavity, until after time is provided to eject the workpiece. Specifically, workpiece ejection lifter arms 100 (FIG. 15), pivotally mounted to the lower platen 14, shift ejection pins 102 up beneath workpiece W, i.e., the finished part, by the action of fluid actuators 104 or the equivalent, to allow manual removal of the workpiece from the cavity. After the ejection, the stop cylinders 86 and 86' retract piston rods 87 and 87' to allow the tool segments to spread, i.e., regap.

Operation of the apparatus is as follows:

With the press open and the platens and tool sections or subassemblies vertically spaced, the operator loads a workpiece W into the lower part of cavity C in lower tool subassembly 18 and starts the press/tool cycle. The mandrels 34 and 36 and locking rings 32A and 32F are axially retracted, the tool segments are axially spread apart, stops 80, 50A, 50B, 50C, 50A', 50B', 50C', 54A, 54B, 54C, 54A', 54B' and 54C' are transversely extended, and holding cylinder 48 and the axial forming cylinder 46 are axially retracted. The press down stroke is stopped with the tool still open at a programmable position, e.g., 1.5 inches from full down.

After stops 80 are extended transversely into position axially behind the segments 16F and 18F, i.e., at the opposite face of segments 16F and 18F from mandrel 36, mandrel 36 and axial locking cylinder 48 are axially extended, and mandrel 34 and axial loading cylinder 46 are partially extended, at the same time, and both held at a predetermined pressure, e.g., about 600 psi, for a programmed time interval, e.g., one second, to flare the workpiece W on both of its ends by action of mandrels 36 and 34 against sleeves 40 and 38 respectively. Cylinder 48 cannot extend further. The axial loading pressure of cylinder 46 is then relieved, allowing stops 80 to be retracted. Axial loading cylinder 46 is then again partially extended and held at a seal pressure of 600 psi. The workpiece W is now in the tool, sealed at both ends, with stops 80 retracted, stops 50A etc. and 54A etc. extended between the tool segments, and all ready for the first transverse offset bend. The workpiece is filled with a liquid such as water, through passageway 37', and a programmable hold pressure, e.g., 1000–1500 psi, is maintained on the liquid until completion of the first and second offset bends. Once the workpiece is at the set cavity hold pressure, the tool is ready to proceed with the first and second transverse offset bends. The first bend is accomplished on the right end of the workpiece, i.e., closest to the locking cylinder 48 and its mandrel 36, by extending hydraulic spring 30 (FIG. 3) downwardly to lower tool segments 16D and 16E, and simultaneously partially advancing the axial loading cylinder 46 an amount of about 1/16 inch to supply material to the bend zone. Thus the first offset is formed.

The second bend starts with the press and platen 12 resuming its down stroke while cylinder 46 partially advances a further amount of about 1/8 inch to further feed workpiece material to the second bend zone beneath tool segments 16B and 16C. When the press stroke is complete, the tool has been fully closed and the second transverse offset is formed by segments 16B and 16C. Stops 50A etc. and 54A etc. were used to limit the axial infeed motion at the completion of the first and second bend offsets of the workpiece. The first and second offsets are now complete with axial loading cylinder at the seal pressure of 600 psi, and the hydraulic intensifier applies a cavity hold pressure of 1000–1500 psi to cause the first hydroforming step. The tool is now opened a small amount to a predetermined open position, e.g., about 5/8 inch. At this point the intensifier is decompressed, allowing axial loading cylinder 46 to relax and relieve pressure on stops 50A etc. and 54A etc. These stops are then laterally retracted. Axial loading cylinder 46 is then again extended and re-establishes a seal pressure of about 600 psi on the flared ends of the workpiece.

The workpiece is now held in the tool, sealed at both ends with the stops retracted, ready for the next intensifier pressure action and continued axial loading. The pressure on the liquid in the workpiece is then intensified to a programmable hold pressure of about 4000 psi for the second hydroforming step, and axial loading by cylinder 46 on mandrel 38 is again begun at the same time. It is desired to expand the metal workpiece an amount between about 15% and 40%, depending on the desired final product. This hydroforming step expands the tubular metal workpiece all but about 6% of the total expansion, while the tool segments are axially forced closed into contact with each other, against the bias of springs 26A etc. and 28A etc., until all of the tool segments 16 etc. and 18 etc. abut each other against the fixed segments 16F and 18F under the influence of the axially advancing mandrel 38 which feeds workpiece metal toward the central area of the tool cavity as this hydroforming step occurs.

When at the fixed positive stop position, the axial load is held at the seal pressure of about 1000 psi, the intensifier is held at the cavity hold pressure of about 4000 psi on the liquid in the workpiece, and the press is then totally closed. Pressure of the liquid in the workpiece is then tremendously increased to about 12000 psi. This causes the third hydroforming step to expand the workpiece the final 6% to hydroform the workpiece completely to the exact tool cavity configuration for the finished part. At completion of the hydroform cycle, the intensifier is decompressed, and axial loading cylinder 46 is retracted enough to allow clearance to open the tool. The mandrel cylinder 48 is then fully retracted, and the locking rings retracted, while restraining cylinders 86 and 86' keep the lower and upper tool segments from axially separating. The press is opened. The axial loading cylinder 48 is fully retracted. Ejector cylinders 104 (FIG. 15) are actuated to eject the workpiece up out of the cavity C. The stop cylinders 86 and 86' are then retracted, allowing the tool segments to separate, and hydraulic spring cylinder 30 is extended to act as a stripper for the finished part. The operator then unloads the finished workpiece, ready to begin another cycle. The finished workpiece may be cut into two like final products.

Those familiar with this art will likely conceive of certain modifications to suit a particular final product. It is intended that the invention not be limited to the exemplary preferred embodiment set forth, but only by the scope of the claims and the equivalents thereof.

The embodiments of the invention in which an exclusive property or privilege is claimed are defined as follows:

1. Apparatus for reconfigurating a tubular workpiece comprising:

upper and lower press platens;

upper and lower tool subassemblies mounted to said upper and lower platens, respectively, and defining therebetween a cavity which is elongated in an axial dimension, is transversely offset configurated, and is open on its axial ends, to receive an axially elongated tubular workpiece in said elongated cavity;

said upper and lower tool subassemblies being movable vertically together or apart, and each formed of a plurality of tool segments movable axially into engagement with each other, or out of engagement with each other to be spaced from each other in said axial dimension, and means for forcefully vertically shifting said upper and lower tool subassemblies toward each other;

said upper tool segments being independently vertically movable in a manner capable of sequentially gripping end portions of a tubular workpiece in said cavity, and then transversely offset forming other portions of the tubular workpiece, and means for sequentially vertically moving said upper tool segments independently of vertical movement of other of said upper tool segments, for sequential gripping of end portions and mechanical forming of other portions of the workpiece;

a pair of mandrels adjacent said axial ends of said elongated cavity for retention of a tubular workpiece therebetween, for closure and sealing of the ends of the tubular workpiece in said elongated cavity, and for forcing the workpiece material axially inwardly;

liquid supply means to said cavity for filling a workpiece in said cavity with liquid;

means for forcefully axially shifting said mandrels toward each other to compress the workpiece axially while said upper and lower tool subassemblies are moved vertically together and for axially shifting said segments of each of said upper and lower tool subassemblies together; and hydroforming pressurizing means operably associated with said cavity for applying hydroforming pressure to liquid in the workpiece in a manner to controllably hydroform expand the offset reconfigured tubular workpiece to the specific shape of said cavity.

2. The apparatus in claim 1 wherein said upper tool subassembly segments include endmost segments, and said means for vertically moving at least some of said upper tool segments shifts said endmost tool segments first to grip the ends of a workpiece in said cavity.

3. The apparatus in claim 2 wherein said mandrels and said tool subassemblies are cooperatively tapered for flaring the ends of a workpiece in said cavity.

4. The apparatus in claim 3 wherein said upper and lower tool subassemblies have axially spaced ends;

said means for moving said tool segments of said upper and lower tool subassemblies toward each other being at one of said axially spaced ends; and said apparatus including shiftable primary stops for securing said endmost tool segments at said one end during said flaring, said primary stops being retractable after said flaring is complete.

5. The apparatus in claim 1 including a plurality of spaced, shiftable stops between said upper tool segments and between said lower tool segments when spaced from each other, to control axial shifting of said tool segments together, said stops being retractable from between said upper and lower tool segments to allow said axial shifting of said tool segments.

6. The apparatus in claim 2 wherein said endmost tool segments have workpiece gripping surfaces at said axial ends of said elongated cavity.

7. The apparatus in claim 6 wherein said workpiece gripping surfaces comprise cooperative half-round clamping hemi-surfaces at each of said axial ends of said upper tool endmost segments and said lower tool endmost segments, to cooperatively form a fully circular, annular gripping surface at each end of said cavity.

8. The apparatus in claim 1 wherein said upper tool segments are vertically movable in at least three separate groups and including tool movement actuators for moving said groups independently of the others.

9. The apparatus in claim 1 including a pair of annular, axially-inwardly extending tool locking rings around and spaced radially outwardly of said mandrels, and having an inner diameter, each of said endmost tool segments of said upper and lower tool subassemblies having semi-annular, axially-outwardly extending lockable elements on both axial ends of said tool subassemblies, to cooperatively form annular lockable elements when said tool subassemblies are closed on each other, said annular lockable elements having an outer diameter substantially equal to said inner diameter of said tool locking rings for interfit therewith, to lock said upper and lower tool subassemblies together when an inner pressure is applied to a workpiece in said cavity.

10. The apparatus in claim 9 including means allowing limited lost axial motion between said locking rings and said mandrels, enabling said mandrels to be axially retracted a limited controlled amount without retraction of said locking rings.

11. The apparatus in claim 10 wherein said lost motion is allowed and is limited by shoulder pins.

12. The apparatus in claim 10 including compression springs between said upper tool segments and compression springs between said lower tool segments, applying a bias tending to spread said tool segments apart, and wherein upon said limited retraction of said mandrels, said tool segments tend to be biased apart a limited amount.

13. Apparatus for reconfigurating a tubular workpiece comprising:

upper and lower press platens;

upper and lower tools mounted to said upper and lower platens, respectively, and defining therebetween a cavity which is elongated in an axial dimension, is transversely offset configurated, and is open on its axial ends, to receive an axially elongated tubular workpiece in said elongated cavity;

said upper and lower tool subassemblies being movable vertically together or apart, and each formed of a plurality of tool segments movable axially into engagement with each other, or spaced from each other in said axial dimension;

a pair of mandrels adjacent said axial ends of said elongated cavity for retention of a tubular workpiece therebetween, for closure and sealing of the ends of the tubular workpiece in said elongated cavity, and for forcing workpiece material axially inwardly;

means for forcefully axially shifting said mandrels toward each other to engage a tubular workpiece and compress it axially, and for forcefully axially shifting said upper and lower tool segments into engagement with each other;

hydroforming fluid supply and pressurizing means operably associated with said mandrels for controllably hydroform expanding the reconfigured tubular workpiece in said elongated cavity to the specific shape of said cavity;

a pair of annular, axially-inwardly extending tool locking rings around and spaced radially outwardly of said mandrels, and having an inner diameter;

each of the endmost ones of said upper and lower tool segments having semi-annular, axially-outwardly extending lockable elements on both axial ends of said tool subassemblies to cooperatively form annular lockable rings;

said annular lockable elements having an outer diameter substantially equal to said inner diameter of said tool locking rings for interfit therewith to lock said upper and lower endmost tool segments together during hydroform expansion of the workpiece.

14. The apparatus in claim 13 including a plurality of stops between said upper tool segments and between said lower tool segments, said stops being retractable from between said upper and lower tool segments to allow said axial shifting of said tool segments together.

15. The apparatus in claim 13 including workpiece gripping elements comprising cooperative clamping hemisurfaces at each of said axial ends of said upper tool subassembly and said lower tool subassembly, to cooperatively form fully annular clamping surfaces.

16. The apparatus in claim 13 wherein said tool segments at said axial ends of said elongated cavity are frustoconically tapered, and said mandrels are frustoconically tapered in like manner as said cavity ends, for cooperatively forming frustoconically flared ends on a tubular workpiece therebetween.

17. The apparatus in claim 13 wherein said upper tool subassembly segments include endmost tool segments, and means for vertically moving said endmost tool segments first to grip the ends of a workpiece in said cavity.

18. The apparatus in claim 17 wherein said upper tool segments are independently vertically movable toward said lower tool segments.

19. The apparatus in claim 18 wherein said upper and lower tool subassemblies have axially spaced ends, said means for moving said tool segments of said upper and said lower tool subassemblies axially toward each other comprising a loading fluid actuator at one of said axially spaced ends, and said apparatus including shiftable primary stops for securing said endmost tool segments at said one end during said flaring, said primary stops being retractable after flaring is complete.

20. The apparatus in claim 13 wherein said segments of said upper tool subassembly are independently vertically shiftable to sequentially grip end portions of a workpiece and then offset form other portions of the workpiece.

* * * * *